US009277821B2

(12) United States Patent
Jones et al.

(10) Patent No.: US 9,277,821 B2
(45) Date of Patent: Mar. 8, 2016

(54) TILT MECHANISM FOR A CHAIR AND CHAIR

(75) Inventors: Mark Grant Jones, Lancashire (GB); Alessandro Slongo, Mogliano Veneto (IT); Massimo Costaglia, Santa Giustina in Colle (IT)

(73) Assignee: L&P Property Management Company, South Gate, CA (US)

( * ) Notice: Subject to any disclaimer, the term of this patent is extended or adjusted under 35 U.S.C. 154(b) by 0 days.

(21) Appl. No.: 14/128,337

(22) PCT Filed: Jul. 1, 2011

(86) PCT No.: PCT/EP2011/003276
§ 371 (c)(1),
(2), (4) Date: Apr. 22, 2014

(87) PCT Pub. No.: WO2013/004253
PCT Pub. Date: Jan. 10, 2013

(65) Prior Publication Data

US 2014/0300158 A1 Oct. 9, 2014

(51) Int. Cl.

| | |
|---|---|
| ***A47C 1/024*** | (2006.01) |
| ***A47C 1/032*** | (2006.01) |
| ***A47C 7/46*** | (2006.01) |

(52) U.S. Cl.
CPC ..... *A47C 1/024* (2013.01); *A47C 1/03238* (2013.01); *A47C 1/03255* (2013.01); *A47C 1/03266* (2013.01); *A47C 1/03272* (2013.01); *A47C 1/03294* (2013.01); *A47C 7/462* (2013.01)

(58) Field of Classification Search
CPC ..... A47C 1/024; A47C 1/03266; A47C 1/03238; A47C 1/0325; A47C 1/03294; A47C 1/03272; A47C 7/462; A47C 7/443; A47C 7/445; A47C 7/44; A47C 1/03255
USPC ..... 297/289, 285, 300.1, 300.2, 300.5, 297/300.7, 300.8, 301.1, 301.4, 301.5, 297/301.6, 301.7, 303.1, 303.4
See application file for complete search history.

(56) References Cited

U.S. PATENT DOCUMENTS

| | | | | | |
|---|---|---|---|---|---|
| 3,417,956 | A | * | 12/1968 | Helms | 248/576 |
| 4,709,962 | A | * | 12/1987 | Steinmann | 297/300.3 |
| 5,725,276 | A | * | 3/1998 | Ginat | 297/289 |
| 5,762,399 | A | * | 6/1998 | Liu | 297/302.7 |
| 5,775,774 | A | | 7/1998 | Okano | |

(Continued)

FOREIGN PATENT DOCUMENTS

| | | | |
|---|---|---|---|
| CN | 1623471 | A1 | 12/2003 |
| DE | 1353584 | B1 | 8/2007 |

*Primary Examiner* — Joshua J Michener
*Assistant Examiner* — Matthew Gitlin
(74) *Attorney, Agent, or Firm* — Shook, Hardy & Bacon, L.L.P.

(57) ABSTRACT

A tilt mechanism is configured for adjustment of a tension applied by a chair back. The tilt mechanism includes a base, a back bracket tiltably supported on the base, and a rocker coupled to the back bracket so as to be moveable relative to the back bracket. The rocker has a pivot axis and pivots about the pivot axis when the back bracket tilts relative to the base. An energy storage mechanism is coupled to the rocker to exert a force onto a portion of the rocker. An actuating mechanism is coupled to at least one of the rocker or the energy storage mechanism and is configured to alter a distance between the pivot axis and the portion of the rocker at which the force is exerted onto the rocker, thereby altering a length of a lever arm.

21 Claims, 8 Drawing Sheets

(56) References Cited

U.S. PATENT DOCUMENTS

| | | | | |
|---|---|---|---|---|
| 6,033,020 | A * | 3/2000 | Ito | 297/302.4 |
| 2003/0132653 | A1 | 7/2003 | Thole | |
| 2004/0140702 | A1 | 7/2004 | Daeschle | |
| 2004/0160102 | A1 * | 8/2004 | Stumpf | 297/303.5 |
| 2004/0174059 | A1 | 9/2004 | Elzenbeck | |
| 2004/0195881 | A1 * | 10/2004 | Wells | 297/262.1 |
| 2005/0236878 | A1 * | 10/2005 | Rossetto et al. | 297/300.8 |

* cited by examiner

TILT MECHANISM FOR A CHAIR AND CHAIR

CROSS-REFERENCE TO RELATED APPLICATIONS

This application claims priority to PCT Application No. PCT/EP2011/003276, titled "Tilt Mechanism For a Chair and Chair," filed Jul. 1, 2011, which is expressly incorporated by reference herein in its entirety.

FIELD OF THE INVENTION

The invention relates to a tilt mechanism for a chair and to a chair. The invention relates in particular to a tilt mechanism for a chair having a chair back which exerts a force onto an occupant when the chair back is reclined, and in which the force exerted by the chair back as a function of recline angle is adjustable.

BACKGROUND OF THE INVENTION

For a wide variety of applications, chairs are nowadays provided with features which provide enhanced comfort to the person using the chair. For illustration, office-type chairs are commonly utilized in modern working environments to provide an occupant with a level of comfort while performing certain tasks that require a person to be in a seated position for an extended period of time. One common configuration for such a chair includes a mobile chair base assembly to allow the chair to roll across a floor and a pedestal column supporting the superstructure of the chair. The superstructure may include components which enable the user to adjust certain settings of the chair and to facilitate recline or "tilt" of the chair superstructure, including the back and frequently also the seat of the chair. Such a chair configuration allows users to change their sitting position in the chair as desired. Fatigue may be reduced during long sitting periods.

In recent years, chair designs have implemented a feature where a chair back exerts an increasing force onto the seat occupant as a function of recline angle, during a rearward reclining movement of the chair back. The chair seat may also tilt in this process or may be displaced otherwise relative to the chair base. To this end, a spring may be provided which is compressed when the chair back reclines. The torque which must be exerted onto the chair back to maintain the chair back at a given recline angle increases as a function of recline angle. Vice versa, the force exerted onto the occupant by the chair back increases.

For enhanced comfort, it is desired that the force applied by the chair back can be adjusted. For illustration, a light-weight user may prefer a configuration which requires less force to be applied onto the chair back to recline it by a given angle. A heavier user may prefer recline characteristics which requires him to exert a greater force onto the chair back to recline it by the same given angle. The chair may have a tension adjust system which allows the torque which must be exerted onto the chair back in a recline movement, as a function of recline angle, to be adjusted.

One approach to implement such a tension adjust system is to alter an offset bias or pretension of the spring. This can be attained by altering an offset-compression of the spring. An offset force can thus be added to the force applied by the spring. Such an approach has various shortcomings. For illustration, it may be a considerable challenge to adjust the offset bias in a state in which the chair back is already reclined and the spring is already compressed to a certain degree. For further illustration, adjust mechanisms that allow the offset bias to be adjusted frequently need to be implemented such that an actuating lever must complete several full turns, often more than five turns, to alter the recline characteristics from the softest to the hardest recline characteristics. For further illustration, depending on the arrangement of the spring on the chair, an adjust mechanism which adjusts an offset bias may make it difficult for the user to adjust the recline characteristics while remaining seated on the chair.

Another shortcoming of an adjust mechanism which alters an offset bias is that the torque curve as a function of recline angle is merely shifted by an offset. It may be desirable to provide an adjust mechanism which provides enhanced versatility in adjusting the recline characteristics from soft to hard.

There is a need in the art for a tilt mechanism and for a chair which provide good support to the user during a reclining motion. There is a need in the art for such a tilt mechanism and chair which allow the recline characteristics, i.e., the torque as a function of recline angle of the chair back, to be adjusted in a versatile manner. There is also a need for such a tilt mechanism and chair in which the adjust mechanism for adjusting the tension applied by the chair back can be actuated more conveniently, also in a state in which the chair back is already reclined.

SUMMARY

There is a continued need in the art for a chair tilt mechanism and a chair which address some of the above needs.

According to an embodiment, a tilt mechanism is provided. The tilt mechanism is configured for adjustment of a tension applied by a chair back. The tilt mechanism comprises a base, a back bracket, a rocker, an energy storage mechanism and an actuating mechanism. The back bracket is tiltably supported on the base and configured to be attached to the chair back. The rocker has a pivot axis provided at a fixed location relative to the rocker. The rocker is coupled to the back bracket so as to be moveable relative to the back bracket, such that the rocker pivots about the pivot axis when the back bracket tilts relative to the base. The energy storage mechanism is coupled to the rocker to exert a force onto a portion of the rocker that is spaced from the pivot axis by a distance. The actuating mechanism is coupled to at least one of the rocker or the energy storage mechanism and is configured to alter the distance between the pivot axis and the portion of the rocker at which the force is exerted onto the rocker.

According to another embodiment, a chair is provided. The chair comprises a chair base assembly, a chair seat, a chair back and a tilt mechanism. The tilt mechanism comprises a base attached to the chair base assembly, a back bracket to which the chair back is attached, a rocker, an energy storage mechanism and an actuating mechanism. The back bracket is tiltably supported on the base. The rocker has a pivot axis provided at a fixed location relative to the rocker. The rocker is coupled to the back bracket so as to be moveable relative to the back bracket, such that the rocker pivots about the pivot axis when the back bracket tilts relative to the base. The energy storage mechanism is coupled to the rocker to exert a force onto a portion of the rocker that is spaced from the pivot axis by a distance. The actuating mechanism is coupled to at least one of the rocker or the energy storage mechanism and is configured to alter the distance between the pivot axis and the portion of the rocker at which the force is exerted onto the rocker.

The tilt mechanism and chair according to embodiments may be utilized for various applications in which it is desired to adjust the recline characteristics of the chair back.

Additional objects, advantages, and novel features of the invention will be set forth in part in the description which follows, and in part will become apparent to those skilled in the art upon examination of the following, or may be learned by practice of the invention.

BRIEF DESCRIPTION OF THE SEVERAL VIEWS OF THE DRAWING

The present invention is described in detail below with reference to the attached drawing figures, wherein.

DETAILED DESCRIPTION OF THE INVENTION

Figure 1:
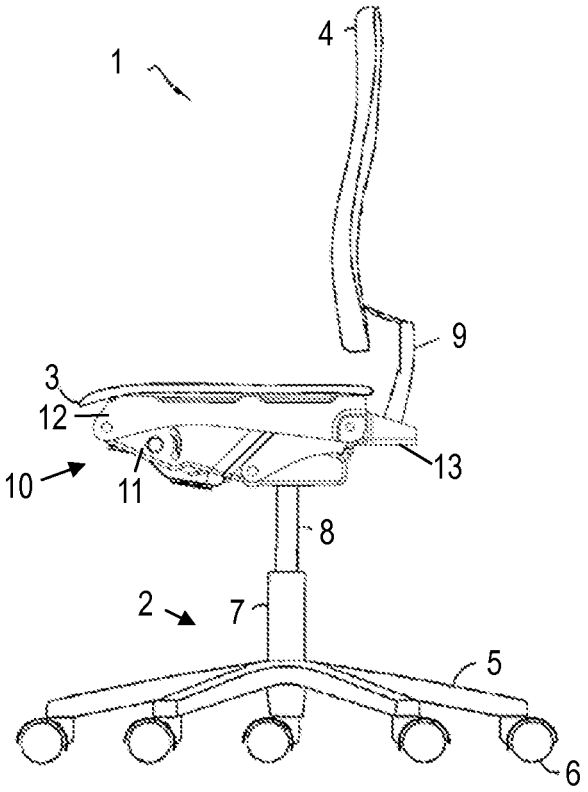
FIG. 1 is a side view of a chair having a chair tilt mechanism according to an embodiment.

Exemplary embodiments of the invention will be described with reference to the drawings. While some embodiments will be described in the context of specific fields of application, such as in the context of an office-type chair, the embodiments are not limited to this field of application. The features of the various embodiments may be combined with each other unless specifically stated otherwise. Throughout the following description, same or like reference numerals refer to same or like components or mechanisms.

According to embodiments, a tilt mechanism having a tension adjust mechanism is provided. Using the tension adjust mechanism, the recline characteristics of the chair back, i.e., the torque that needs to be applied to the chair back to maintain the chair back at a given recline angle, can be adjusted.

FIG. 1 shows a chair 1 which includes a tilt mechanism 10 of an embodiment. The chair 1 is illustrated to be an office-type chair having a chair base assembly 2 and a superstructure. The superstructure includes a chair seat 3, a chair back 4 and the tilt mechanism 10 to which the chair seat 3 and chair back 4 are connected. The tilt mechanism 10 may be configured to effect a coordinated movement of the back 4 and the seat 3. The base assembly 2 includes a pedestal column 7, a number of support legs 5 extending radially from the column 7 and a corresponding number of castors 6 operably supported on the outer ends of the support legs 5. A gas cylinder or other lifting mechanism may be supported by the column 7 to enable the height of the seat 3, and thus of the chair superstructure, to be adjusted by an occupant.

It should be understood that the terms "forward," "backward," and "lateral," as used herein, each have a particular meaning that is defined in relation to a base plane defined by the chair base assembly 2 (e.g., parallel to a floor on which castors 6 rest) and in relation to an occupant of the chair. The flat support surface is defined by the chair base assembly 2. For instance, the term "forward" refers to a direction moving away from the back 4 and in front of a chair occupant along an axis which extends parallel to such a base plane, while the term "backward" refers to a direction opposite of the forward direction. The term "lateral" refers to a direction perpendicular to both the forward and rearward direction and extending parallel to the aforementioned base plane. Terms such as "upward" and "downward" refer to a movement away from or towards the support plane, in a direction normal to the support plane. When used in connection with the tilt mechanism, the terms "forward," "backward," "lateral," "upward," and "downward" are used to refer to the sides or directions of the tilt mechanism or components thereof which, in the installed state, correspond to the particular meaning of the directions indicated above. The tilt mechanism 10 has a mounting structure for mounting to the chair base assembly 2, such that the indicated directions have a well-defined meaning for the tilt mechanism. For illustration, the "backward" end of the tilt mechanism 10 is the end at which the chair back 4 is attached. The "forward-backward direction" of the tilt mechanism is the direction which, in the installed state of the tilt mechanism, extends parallel to the base plane of the chair base assembly 2 between backward and forward ends of the tilt mechanism 10.

The tilt mechanism 10 is operative to apply an increasing torque onto the chair back 4 as the chair back 4 is reclined, which in turn causes the chair back 4 to exert a force onto the occupant which increases with recline angle. The tilt mechanism 10 may be configured to implement a coordinated movement of the seat 3 and of the back 4 when the back 4 is tilted.

The tilt mechanism 10 includes a base 11 which, in the installed state of the tilt mechanism in which the tilt mechanism 10 is incorporated into the chair 1, is coupled to the pedestal column 7 or another component of the chair base assembly. The tilt mechanism 10 includes a back bracket 12 which, in the installed state of the tilt mechanism 10, is attached to the chair back 4 and mounts the chair back 4. The chair back 4 may be fixedly coupled to the back bracket 12. As will be described in more detail below, the back bracket 12 is tiltably attached at the base 11. The tilt mechanism 10 further includes a rocker coupled to the back bracket and an energy storage mechanism which exerts a force onto the rocker, so as to exert a torque onto the chair back. The tilt mechanism 10 has an actuating mechanism which allows a geometrical arrangement of the rocker and energy storage mechanism to be modified, thereby causing lever arms to be adjusted. Thereby, the recline characteristics of the tilt mechanism 10 may be adjusted.

A tilt mechanism according to an embodiment generally includes a base, a back bracket, a rocker, an energy storage mechanism and an actuating mechanism. The back bracket is tiltably supported on the base. The rocker, energy storage mechanism and actuating mechanism are configured to allow a torque exerted onto the back bracket and, thus, a torque exerted onto the chair back when the tilt mechanism is installed, to be adjusted. The torque can be adjusted by altering the length of at least one lever arm.

The rocker has a pivot axis which is provided at a fixed location relative to the rocker. The rocker is coupled to the back bracket so as to be moveable relative to the back bracket. The rocker pivots about the pivot axis when the back bracket tilts relative to the base. The energy storage mechanism is coupled to the rocker to exert a force onto a portion of the rocker, the portion being spaced from the pivot axis by a distance. The actuating mechanism is coupled to at least one of the rocker or the energy storage mechanism and is configured to alter the distance between the pivot axis and the portion of the rocker at which the force is exerted onto the rocker, thereby altering a length of a lever arm.

With a tilt mechanism having this configuration, a tension adjustment may be made by changing the relative geometrical arrangement between rocker pivot and the location at which the energy storage mechanism exerts a force onto the rocker. Such a configuration allows the tension adjustment to be made without requiring the application of large forces, even when the chair back is already reclined. The torque curve as a function of recline angle may have different slopes for hard and soft recline characteristics, providing enhanced versatility. The change in slope may be controlled by adjusting the tilt mechanism geometry.

The rocker is moveable relative to the back bracket. This allows torque to be efficiently exerted onto the back bracket, while the rocker moves relative to the back bracket when the chair back is reclined.

The rocker pivot has a fixed location relative to the rocker. Thereby, a tension adjustment may be performed using an actuating mechanism which can be positioned at a wide variety of locations on the tilt mechanism.

The actuating mechanism may include a lever or other manually operable actuating element. The actuating mechanism may be configured such that less than five full 360° turns of the actuating element are required to alter the distance between the pivot axis and the portion of the rocker at which the force is exerted onto the rocker from the softest to the hardest recline characteristics. The actuating mechanism may be configured such that less than one full 360° turn of the actuating element is required to alter the distance between the pivot axis and the portion of the rocker at which the force is exerted onto the rocker from the softest to the hardest recline characteristics. When the tilt mechanism geometry is altered to adjust the recline characteristics, forces which must be applied in an adjustment may be reduced as compared to approaches where the bias of a spring is directly adjusted. Thus, an actuating mechanism can be used which requires less manual actuation to adjust the tilt mechanism from the softest recline characteristics to the hardest recline characteristics.

The actuating mechanism may be configured to effect a relative displacement between the rocker and the energy storage mechanism. Thereby, a length of at least one lever arm may be adjusted.

The actuating mechanism may be configured to effect a translational displacement of at least one of the pivot axis of the rocker or the energy storage mechanism relative to the base. The energy storage mechanism may include a resiliently deformable member having a deformation axis, and the actuating mechanism may be configured to alter a distance between the deformation axis and the pivot axis. The resiliently deformable member may be a spring.

The tilt mechanism may comprise a guide, in particular a linear guide, to guide the translational displacement. The guide may extend in a direction which is transverse to the deformation axis of the resiliently deformable member. The guide may extend in a forward-backward direction of the tilt mechanism. Thereby, force components in a direction normal to the guide and acting onto the rocker and/or energy storage mechanism when the chair back is reclined are absorbed in the tilt mechanism and do not counteract a displacement of the rocker and/or energy storage mechanism along the guide.

The rocker may have an interface section which is slideably engaged with the energy storage mechanism. The interface section may be dimensioned and arranged such that it remains engaged with the energy storage mechanism when the actuating mechanism effects the relative displacement between rocker pivot and the energy storage mechanism.

The back bracket may be supported on the base so as to be tiltable about a tilt axis, which is spaced from the pivot axis of the rocker. Torque may be efficiently exerted onto the back bracket by the rocker.

The rocker may exert a further force onto the back bracket, and the actuating mechanism may be configured to alter a length of a lever arm of the further force relative to the tilt axis. This length adjustment may be made in addition to adjusting the lever arm length between the pivot axis of the rocker and the portion of the rocker at which the energy storage mechanism exerts the force onto the rocker.

The rocker may have a coupling section engaged with the back bracket. The actuating mechanism may be configured to, upon actuation of the actuating mechanism, displace the coupling section relative to the base. Thereby, another lever arm length may be adjusted upon actuation of the actuating mechanism. The coupling section may include a roller abutting against a planar surface of the back bracket.

The tilt axis of the back bracket is located in a plane which is normal to a forward-backward direction of the tilt mechanism. The actuating mechanism may be configured to displace the coupling section away from this plane and to simultaneously increase the distance between the pivot axis and the portion of the rocker, when the actuating mechanism is actuated in a first direction. The actuating mechanism may be configured to displace the coupling section towards the plane in which the tilt axis is located and to simultaneously decrease the distance between the pivot axis and the portion of the rocker, when the actuating mechanism is actuated in a second direction opposite to the first direction. For a tilt mechanism having such a configuration, various geometrical adjustments are made in response to an actuation of the actuating mechanism, which co-operate to make the recline characteristics harder or softer.

When the rocker has a coupling section engaged with the back bracket, the actuating mechanism may additionally or alternatively be configured to, upon actuation of the actuating mechanism, alter an angle between a line connecting the coupling section and the pivot axis of the rocker and another line connecting the coupling section and the tilt axis.

The actuating mechanism may be configured to decrease the angle and to simultaneously increase the distance between the pivot axis and the portion of the rocker, when the actuating mechanism is actuated in a first direction. The actuating mechanism may be configured to increase the angle and to simultaneously decrease the distance between the pivot axis and the portion of the rocker, when the actuating mechanism may be actuated in a second direction opposite to the first direction. For a tilt mechanism having such a configuration, various geometrical adjustments are made in response to an actuation of the actuating mechanism, which co-operate to make the recline characteristics harder or softer.

The energy storage mechanism may include a resiliently deformable member and a deformation guide guiding the resiliently deformable member upon deformation. Thereby, stability is enhanced. The deformable member may be a spring. The deformation guide may include a shaft extending along a spring axis in the interior of the spring. A bushing may be interposed between the shaft and the spring. The deformation guide may support opposite ends of the spring. Thereby, wear may be reduced.

The base may extend between first and second ends in a forward-backward direction of the tilt mechanism. The energy storage mechanism may be attached to the base so as to be spaced from the first end and the second end of the base. When a deformation guide is provided, the deformation guide may be attached to the base so as to be spaced from the first end and the second end of the base. This allows a deformable member to be positioned at a location towards the center of the base, where the base has greater height. It is not required to position the deformable member at the forward or backward end of the base, which may be undesirable for both technical and aesthetic reasons.

The tilt mechanism may include a setting mechanism for adjusting an orientation of the deformation guide relative to the base. The deformation guide may have a deformation guide axis along which the resiliently deformable member deforms, and the setting mechanism may be configured to adjust an orientation of the deformation guide axis relative to the base. By allowing the orientation of the deformation guide to be set, control over the recline characteristics may be enhanced further. For illustration, the change of rate of the chair back torque as a function of recline angle for the softest and/or hardest recline characteristics may be set using the setting mechanism.

The setting mechanism may be configured such that it allows the orientation of the deformation guide relative to the base to be adjusted during assembly of the chair, but prevents the end user from using the setting mechanism in the assembled state of the chair. This allows one and the same tilt mechanism to be used for chairs in a wide variety of countries, even when different soft and hard recline characteristics are desired for these different countries. Upon assembly of the chair, the setting mechanism may be adjusted such that the softest recline characteristics shows a rate of change in torque as a function of recline angle which may be selected to be greater in some countries and smaller in other countries.

The rocker may include a first rocker member and a second rocker member, the first and second rocker members being spaced from each other in a direction parallel to the pivot axis. A rocker pivot shaft may extend between the first rocker member and the second rocker member. Thereby, a lightweight construction of the rocker can be realized.

The tilt mechanism may comprise a seat support moveably supported on the base and configured to be attached to a chair seat, and a linkage coupling the seat support to at least one of the rocker or the back bracket. Thereby, the movement of the chair seat may be coupled to the movement of the chair back, so as to further enhance comfort.

Configurations of the tilt mechanism according to embodiments will be described in more detail with reference to FIGS. 2-18.

Figure 2:
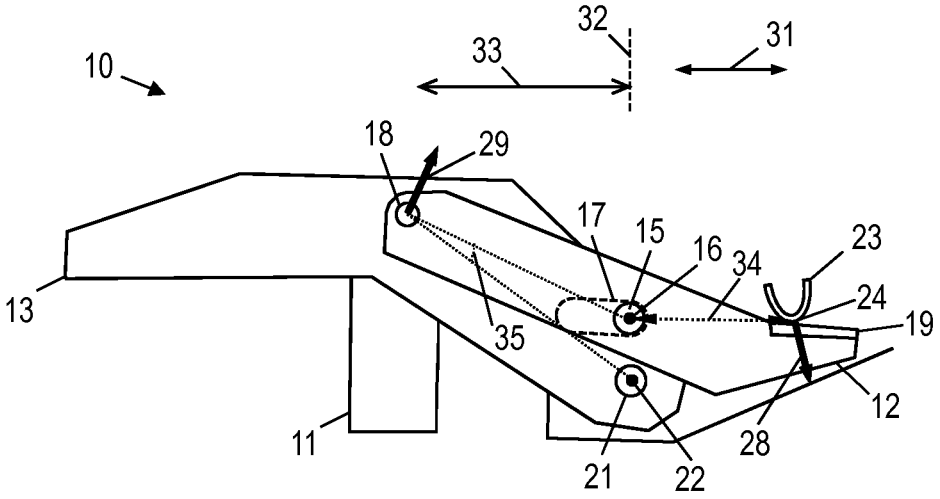
FIG. 2 is a side view of a tilt mechanism having a tension adjust mechanism in a state in which the tilt mechanism provides soft recline characteristics.
Figure 3:
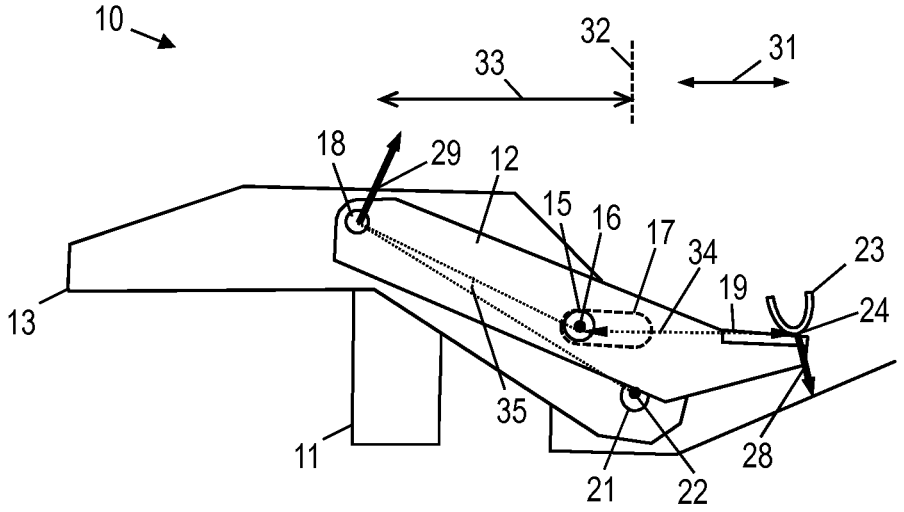
FIG. 3 is a side view of the tilt mechanism of FIG. 2 in a state in which the tilt mechanism provides harder recline characteristics.

FIG. 2 and FIG. 3 are side views of a tilt mechanism 10 according to an embodiment. The tilt mechanism 10 includes a tilt adjustment feature which allows the recline characteristics to be altered. FIG. 2 shows the tilt mechanism in a configuration in which a soft recline characteristics is selected, and FIG. 3 shows the tilt mechanism in a configuration in which a hard recline characteristics is selected.

The tilt mechanism 10 includes a base 11, a rocker 12 and a back bracket 13. The rocker 12 has a rocker pivot 15 about which the rocker 12 may pivot. The pivot 15 may be a shaft extending transverse to a forward-backward direction 31 of the tilt mechanism 10. A center axis 16 of the pivot 15 is the center of the pivoting movement of the rocker 12. As will be described in more detail, the tilt mechanism 10 may be configured such that the pivot 15 can be displaced relative to the base 11 in a translational manner. A guide 17, e.g. a guide slot, may be provided to guide movement of the pivot 15.

The back bracket 13 is supported on the base 11 to be tiltable about a tilt axis 21. The center axis 22 of the tilt axis 21 defines the center of the rotating movement of the back bracket 13 when the chair back is being reclined. The tilt axis 21 is parallel to and offset from the pivot axis 15.

The rocker 12 has a coupling section 18 at which it is moveably coupled to the back bracket 13. The coupling section 18 may have any one of a variety of configurations. For illustration, the coupling section 18 may be or may include a roller which abuts on a planar surface of the back bracket 13. The coupling section 18 may be or may include a protrusion projecting into a recess of the back bracket 13. The coupling between the rocker 12 and the back bracket 13 is such that the rocker 12 pivots about the pivot axis 15 when the back bracket 13 tilts about the tilt axis 21.

The tilt mechanism 10 includes an energy storage mechanism which exerts a force onto the rocker 12. Only a section 23 of the energy storage mechanism is illustrated which is connected to the rocker 12. The section 23 may be operatively coupled to a resiliently deformable member, such as a spring, which forces the section 23 against an interface section 19 of the rocker 12.

In an equilibrium state, a force 28 exerted onto the rocker 12 by the energy storage mechanism causes the rocker 12 to exert a further force 29 onto the back bracket 18. The magnitude of the further force 29 increases with increasing force 28, the relative magnitudes being determined by the lengths of the lever arms relative to the pivot axis 16 and directions of the forces 28, 29.

The further force 29 exerted onto the back bracket 13 at a distance from the tilt axis 21 biases the back bracket 13 in a direction corresponding to clockwise rotation in FIG. 2. The resulting torque exerted by the further force 29 onto the back bracket 13 is the torque which the user must counter-act in order to maintain the chair back at the respective recline angle. When the recline angle increases, the back bracket 13 tilts about the tilt axis 21 and the rocker 12 is forced to pivot about pivot axis 15. The resulting action of the rocker 12 onto the energy storage mechanism causes the spring or other resiliently deformable member to deform, thereby increasing the force 28. The torque, and thus force, which the user must exert onto the chair back to maintain it at the new recline angle increases when the recline angle is increased. Vice versa, the torque, and thus force, which the user must exert onto the chair back to maintain it at the new recline angle decreases when the chair back tilts in a forward direction.

In the tilt mechanism, a distance between the rocker pivot 15 and a location 24 at which the energy storage mechanism exerts the force 28 onto the rocker 12 may be adjusted. An actuating mechanism may displace the rocker with the rocker pivot 15 and/or the energy storage mechanism relative to the base 11. Thereby, the recline characteristics may be adjusted from a soft characteristics to a harder characteristics by altering the geometrical configuration of the tilt mechanism. For the configuration corresponding to harder recline characteristics, the chair back exerts a greater torque and force onto the user for the recline angles which can be realized with the chair.

FIG. 2 shows a state in which the tilt mechanism 10 is set to a configuration corresponding to a soft recline characteristics. FIG. 3 shows a state in which the tilt mechanism 10 is set to a configuration corresponding to a harder recline characteristics. In the state of FIG. 3, the rocker 12 with the rocker pivot 15 is shifted relative to the base 11 and the energy storage mechanism. The rocker 12 is displaced in a translational manner such that, when going from soft to hard recline characteristics, the rocker pivot 15 is moved away from the section 23 of the energy storage mechanism, and the coupling section 18 is moved away from a plane 32 in which the tilt axis 21 is located, respectively increasing the distance.

The resulting change in the geometry of the tilting mechanism has various effects which increase the torque exerted onto the back bracket 13 for the various recline angles which can be supported by the tilt mechanism 10.

One effect is that a distance 34 between the position 24 at which the energy storage mechanism exerts the force 28 onto the rocker 12 and the pivot 15 is increased when the actuating mechanism is actuated to make the recline characteristics harder. A length of a lever arm for force 28 relative to the pivot 15 is thereby increased. When the recline angle is kept constant, this increases the magnitude of the force 29.

Another effect is that a distance 33 at which the coupling section 18 is located from the plane 32 of the tilt axis 21 increases when the actuating mechanism is actuated to make the recline characteristics harder. A length of a lever arm for the further force 29 relative to the tilt axis 21 is thereby increased. When the recline angle is kept constant, this increases the torque applied onto the back bracket by the rocker 12.

These effects co-operate to increase the torque exerted onto the back bracket 13 and, thus, onto the chair back. The effects are reversed when the rocker pivot 15 is displaced in the opposite direction, i.e., in the forward direction of the tilt mechanism. Thereby, the recline characteristics may be made softer.

The above effects have been described for a scenario in which a user maintains the recline angle during an adjustment between soft and hard recline characteristics. If the user maintains a constant torque applied onto the back bracket, the change in tilt mechanism geometry, in particular the change in lever arm lengths, will cause the back bracket 13 to tilt. The rocker 12 pivots. The spring or other resiliently deformable member compresses or uncompresses, until the torque exerted onto the chair back by the tilt mechanism 10 equals the torque exerted onto the chair back by the user.

Yet another effect may be that an angle 35 between a line connecting the coupling section 18 and the pivot 15 and another line connecting the coupling section 18 and the tilt axis 21 may be decreased when the actuating mechanism is actuated to make the recline characteristics harder. Thereby, the further force 29 is made to be located at an angle of closer to 90° relative to the line connecting the connecting portion 18 and the tilt axis 21, again increasing torque.

In the tilt mechanism 10, the position of the rocker pivot 15 may be set by an actuating mechanism. The position of the rocker pivot 15 relative to the base may remain unaltered when the recline angle is changed. The tilt mechanism may be configured such that the position of the rocker pivot 15 relative to the base is altered only when the actuating mechanism is actuated. The actuating mechanism may include self-locking components or one-way transmissions which prevent the position of the rocker pivot 15 to shift unless the actuating mechanism is actuated, for example via a manually operable actuating member.

The actuating mechanism may include a manually operable actuating member. the actuating mechanism may be configured such that the rocker pivot 15 may be transferred from the state in which it is in one extreme position of its translational movement, corresponding to the hardest recline characteristics, to the state in which it is in the other extreme position of its translational movement, corresponding to the softest recline characteristics, with less than five full turns, in particular with less than one full turn, of the manually operable actuating member. A quick adjust mechanism is thereby implemented.

The actuating mechanism may set the distance between the position 24 at which the energy storage mechanism exerts the force 28 and the rocker pivot 15 also to any one of a plurality of intermediate positions. The resulting recline characteristics is intermediate between the softest and hardest recline characteristics.

With reference to FIGS. 4-11, a construction of a tilt mechanism will be described in more detail. The recline characteristics may be adjusted by altering the geometry of the tilt mechanism, similarly to the principle explained with reference to FIGS. 2 and 3. The tilt mechanism of FIGS. 4-11 may operate in accordance with the principles explained with reference to any one of the schematic views of tilt mechanisms.

Figure 4:
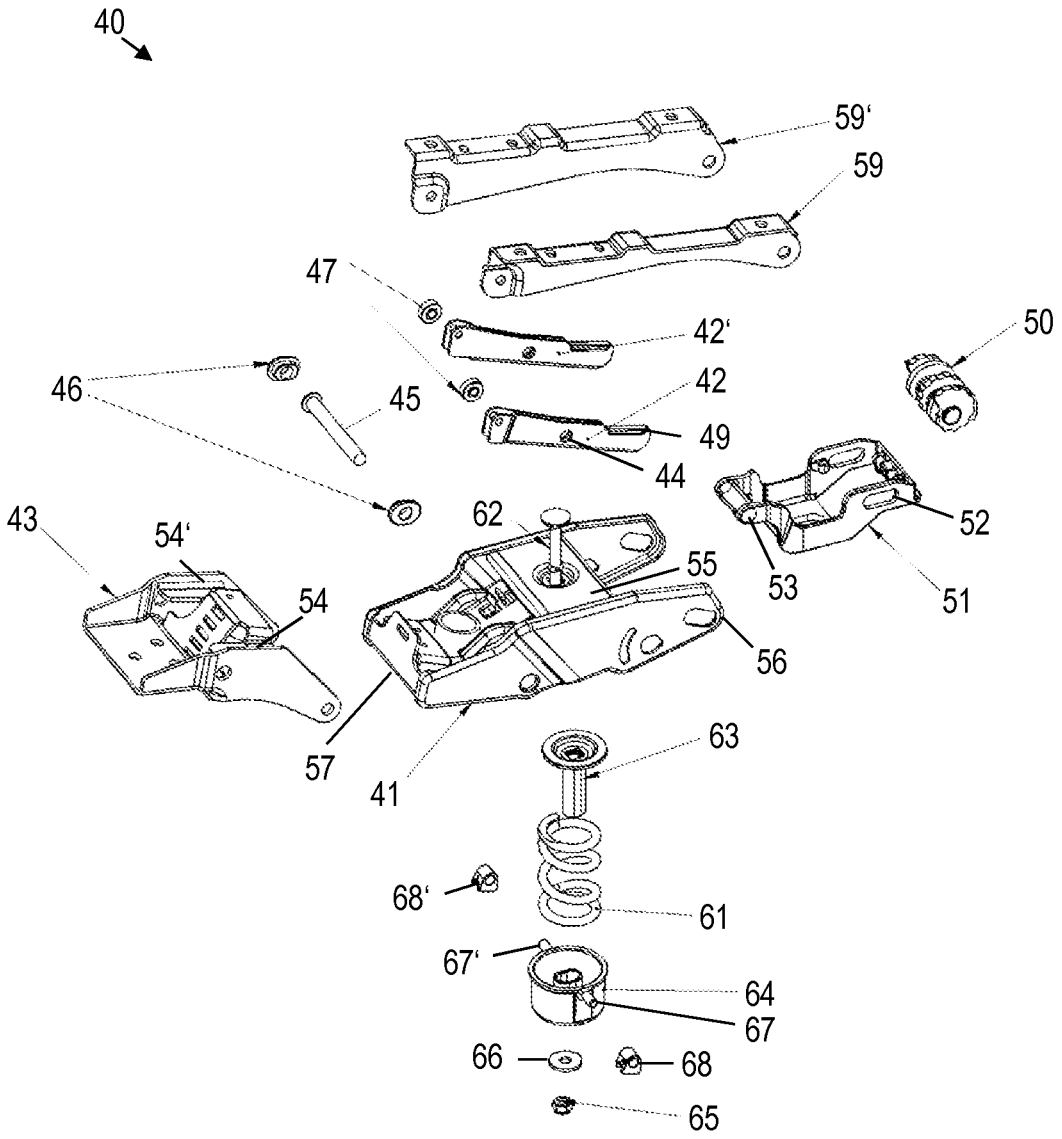
FIG. 4 is an exploded perspective view of a tilt mechanism having a tension adjust mechanism.

FIG. 4 is an exploded view of a tilt mechanism 40 according to an embodiment. The tilt mechanism includes a base 41, a back bracket 43 and a seat support with seat support members 59, 59'. A linkage may be provided to couple a movement of the seat support members 59, 59' to a movement of the chair back. The base 41 has a receptacle 72 (best seen in FIGS. 7 and 9) in which a column of a chair sub assembly may be received.

The tilt mechanism 40 further includes a rocker, an actuating mechanism and an energy storage mechanism which may be operative in accordance with the principles explained with reference to FIGS. 1-3.

The rocker includes two rocker members 42, 42', a rocker pivot 45 and coupling sections 47. The rocker pivot 45 is passed through recesses 44 in the rocker members 42, 42' and secured using a bush 46. The bush 46 may be received in a guide slot. The coupling sections 47 may be attached at the backward facing ends of the rocker members 42, 42'. The coupling sections 47 may be configured as rollers which abut on a corresponding plate-shaped surface 54 and 54' of the back bracket 43. Other configurations of coupling sections 47 may be used. On a forward end, each one of the rocker members 42, 42' has an interface section 49, which is slideably engaged with the energy storage mechanism. The energy storage mechanism exerts a force onto a position on the interface section 49 of the rocker members 42, 42'. The position at which the energy storage mechanism acts onto the interface section can be adjusted using the actuating mechanism.

The energy storage mechanism includes a spring 61. The spring 61 may be a coil spring. Other resiliently deformable members may be used. A deformation guide is provided to guide the deformation of the spring 61. The deformation guide includes a guide shaft 62. The guide shaft 62 extends through the spring, along the spring axis. A guide bush 63 is interposed between the guide shaft 62 and the spring 61. An end of the spring 61 is received in a yoke 64. The guide shaft 62 may extend through the yoke 64. The guide shaft 62, guide bush 63 and yoke 64 in combination securely support both ends of the spring 61, improving durability. In order to secure the yoke 64, a nut 65 and washer 66 may be provided at an end of the guide shaft 62 projecting through the yoke 64. The yoke 64 is moveable along the axial direction of the spring 61. Movement of the yoke 64 along the axial direction of the spring 61 causes the spring 61 to be compressed or uncompressed.

The yoke 64 is provided with sections for exerting the spring force onto the interface section 49 of the rocker member 42 and of the rocker member 42'. A rocker bush 68 has a surface which rests against the interface section 49 of the rocker member 42 and is slideable along the interface section 49. The rocker bush 68 is pivotably supported on a projection 67 provided on the yoke 64. Another rocker bush 68' has a surface which rests against the interface section 49 of the rocker member 42' and is slideable along the interface section 49. The other rocker bush 68' is pivotably supported on another projection 67' provided on the yoke 64.

The energy storage mechanism is provided at a center portion 55 of the base 51. The center portion 55 is spaced from both a forward end 56 and a rearward end 57 of the base 51. This allows the forward and rearward ends of the base 51 to have a height less than a height of the center portion, providing a slim design at the forward and rearward ends.

In the assembled state, the back bracket 43 is supported on the base 41 so as to be tiltable about a tilt axis. The tilt axis 70 is shown in FIGS. 6-11. The coupling sections 47 on the rocker members 42, 42' abut on the plate-shape projections 54, 54' of the back bracket 43. The rocker including the rocker members 42, 42' is moveable relative to the back bracket 43.

When the back bracket 43 tilts about the tilt axis 70, the rocker with the rocker members 42, 42' pivots about the rocker pivot 45. If the recline angle of a chair back is increased when the chair back is reclined further backward, the interface section 49 of the rocker members 42, 42' moves in an upward direction, pressing the yoke 64 against the spring 61 and thus compressing the spring 61 along its spring axis. The force exerted by the spring 61 onto the rocker members 42, 42' increases, thus ultimately increasing the force applied by the backrest onto the occupant. If the recline angle recline angle of the chair back is decreased when the chair back moves forward, the interface section 49 of the rocker members 42, 42' is allowed to move downward, under the action of the spring 61 which presses the yoke 64 against the interface section 49 of the rocker members 42, 42', allowing the spring 61 to uncompress. The force exerted by the spring 61 onto the rocker members 42, 42' decreases, thus ultimately decreasing the force applied by the backrest onto the occupant.

To implement a tension adjust mechanism, the rocker is mounted such that a relative displacement between the rocker pivot 45 and the energy storage mechanism can be brought about under the action of the actuating mechanism. In the tilt mechanism of FIGS. 4-11, the energy storage mechanism is provided at a fixed location on the base. The rocker pivot 45 is moveable relative to the base in a translational manner, under the action of an actuating mechanism. In other embodiments, the rocker pivot may have a fixed location 45 relative to the base and the energy storage mechanism may be moveable along the forward-backward direction of the tilt mechanism. In yet other embodiments, both the rocker pivot 45 and the energy storage mechanism may be moveable relative to the base to adjust the geometry of the tilt mechanism.

The tilt mechanism 40 includes an actuation mechanism which displaces the rocker pivot 45 relative to the base 41 and, thus, relative to the energy storage mechanism in a translational manner. The actuation mechanism may include a pusher 51 having a recess 53 through which the rocker pivot 45 passes. A cam 50, such as a snail cam, may be operatively coupled to the pusher 51 to displace the pusher 51 relative to the base 41. Portions of the cam 50 may extend through a cut-out 52 in a side wall of the pusher 51, in order to allow a manually operable actuating member to be attached thereto. While the energy storage mechanism and rocker members 42, 42' are located away from the forward end of the base 41, the manually operable actuating member may be provided close to the forward end, which is convenient for tilt adjust operations.

Under action of the actuating mechanism, the rocker pivot 45 is displaced relative to the energy storage mechanism. The resulting change in geometry of the tilt mechanism 40 causes the recline characteristics to alter. The force applied by the chair back onto a user may be increased or decreased. The rate at which the force changes as a function of recline angle may also be modified, using the tilt mechanism 40.

The operation principle of the tilt mechanism 40 corresponds to the operation principle of the tilt mechanism 10. Generally, upon displacement of the rocker pivot 45 and of the rocker members 42, 42' at which it is mounted, the lengths of two lever arms may be adjusted. The distance of the rocker bush 68, 68' from the pivot axis 45 of the rocker is altered, thereby adjusting the effective length of the lever arm of the force exerted by the spring 61 onto the rocker. The distance of the coupling sections 47 from the tilt axis 70 of the back bracket 43 may also be altered, thereby adjusting the effective length of the lever arm of the further force exerted by the rocker onto the back bracket 43.

Figure 5:
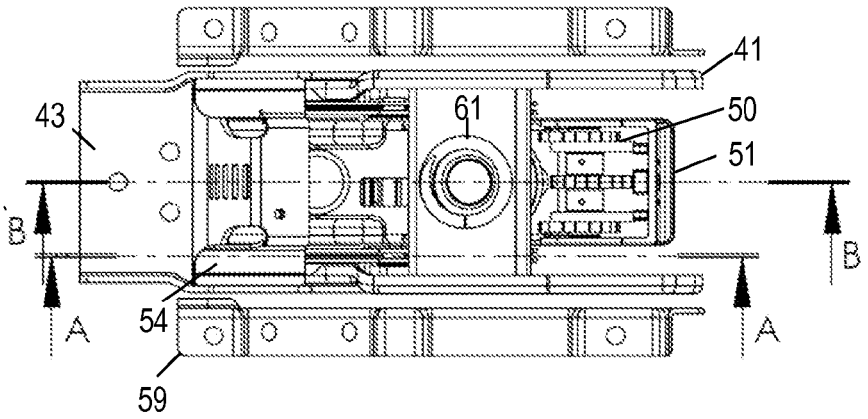
FIG. 5 is a plan view of the tilt mechanism of FIG. 4.
Figure 6:
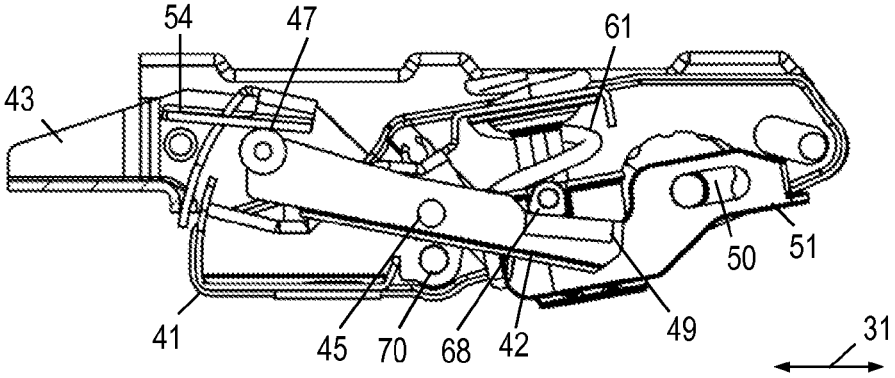
FIG. 6 is a cross-sectional view of the tilt mechanism along line A-A of FIG. 5 in a state in which the chair back is in a forward position and the tilt mechanism has a configuration corresponding to soft recline characteristics.
Figure 7:
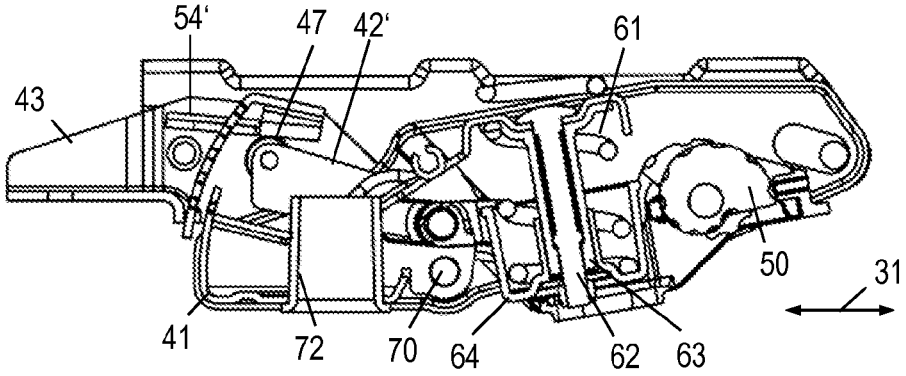
FIG. 7 is a cross-sectional view of the tilt mechanism along line B-B of FIG. 5 in a state in which the chair back is in the forward position and the tilt mechanism has a configuration corresponding to soft recline characteristics.
Figure 8:
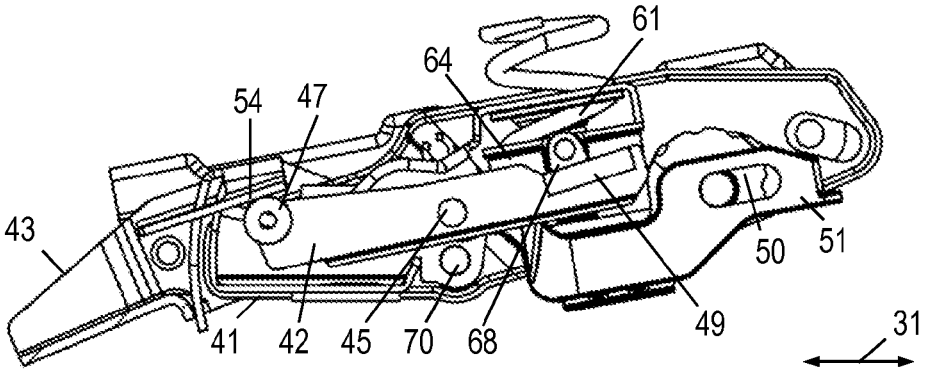
FIG. 8 is a cross-sectional view of the tilt mechanism along line A-A of FIG. 5 in a state in which the chair back is in a reclined position and the tilt mechanism has a configuration corresponding to soft recline characteristics.
Figure 9:
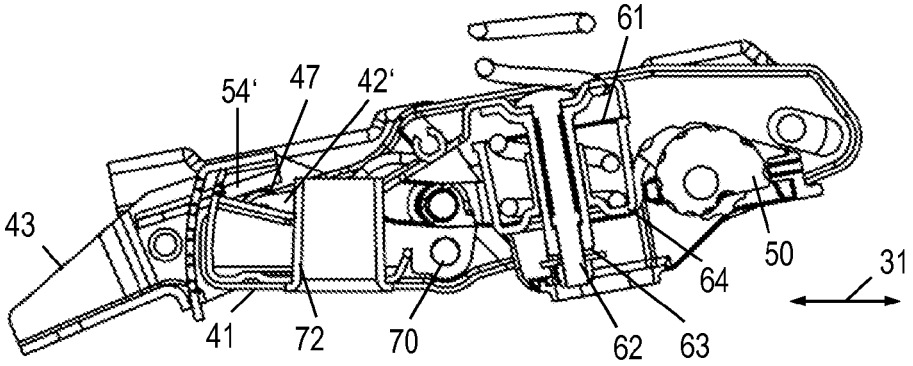
FIG. 9 is a cross-sectional view of the tilt mechanism along line B-B of FIG. 5 in a state in which the chair back is in the reclined position and the tilt mechanism has a configuration corresponding to soft recline characteristics.
Figure 10:
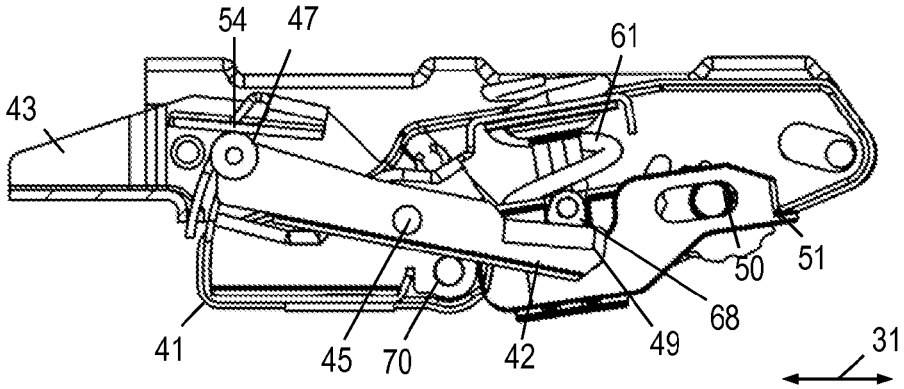
FIG. 10 is a cross-sectional view of the tilt mechanism along line A-A of FIG. 5 in a state in which the chair back is in the forward position and the tilt mechanism has a configuration corresponding to hard recline characteristics.
Figure 11:
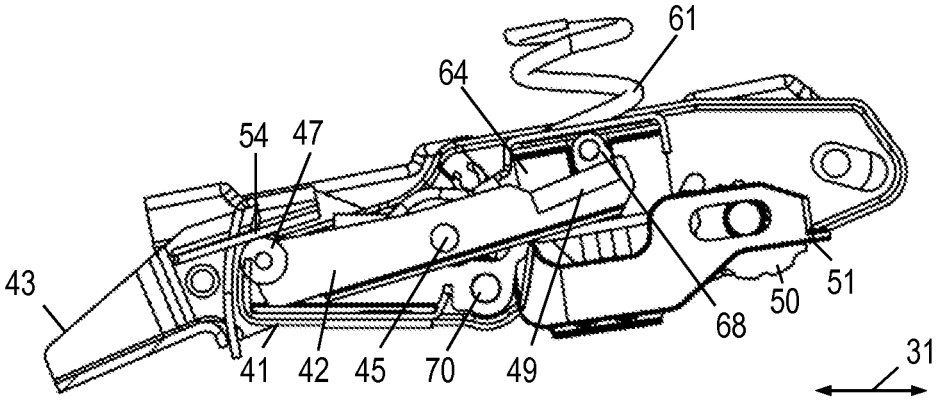
FIG. 11 is a cross-sectional view of the tilt mechanism along line A-A of FIG. 5 in a state in which the chair back is in the rearward position and the tilt mechanism has a configuration corresponding to hard recline characteristics.

FIG. 5 shows a plan view of the tilt mechanism. Lines A-A and lines B-B indicate the planes along which cross-sectional views shown in FIGS. 6-11 are taken. FIGS. 6-11 show cross-sectional views through the tilt mechanism in various operation states and for different geometrical configurations. FIGS. 6 and 7 correspond to a state in which the chair back is in its frontmost position and in which the tilt mechanism has a configuration corresponding to a soft recline characteristics. FIGS. 8 and 9 correspond to a state in which the chair back is in a reclined position and in which the tilt mechanism has a configuration corresponding to the soft recline characteristics. FIG. 10 corresponds to a state in which the chair back is in its frontmost position and in which the tilt mechanism has a configuration corresponding to a hard recline characteristics. FIG. 11 corresponds to a state in which the chair back is reclined and in which the tilt mechanism has a configuration corresponding to the hard recline characteristics is selected.

In other words, FIGS. 8 and 9 when compared to FIGS. 6 and 7 illustrate the effect of a reclining movement of the chair back when the tilt mechanism has a configuration corresponding to the soft recline characteristics. FIG. 11 when compared to FIG. 10 illustrates the effect of a reclining movement of the chair back when the tilt mechanism has a configuration corresponding to the hard recline characteristics. FIG. 10 when compared to FIG. 6 illustrates the effect of adjusting the tilt mechanism from soft to hard recline characteristics when the chair back is in the frontmost position. FIG. 11 when compared to FIG. 8 illustrates the effect of adjusting the tilt mechanism from soft to hard recline characteristics when the chair back is reclined.

FIGS. 6 and 7 show the tilt mechanism 40 in a state which correspond to the state in which the chair back is in its frontmost position and in which a soft recline characteristics is selected. FIG. 6 is a cross-sectional view along line A-A in FIG. 5. FIG. 7 is a cross-sectional view along line A-A in FIG. 5.

The rocker bush 68 which exerts the force from the spring 61 onto the rocker member 42 is arranged at an end of the interface section 49 which is located towards the rocker pivot 45. The coupling section 47 is disposed in a forward position in which it is closer to the plane in which the tilt axis 70 is located than in the state in which harder recline characteristics is selected. The yoke 64 is at its lowermost position, in which the spring 61 has its minimum compression along the spring axis.

FIGS. 8 and 9 show the tilt mechanism 40 in a state which correspond to the state in which the chair back is reclined away from its frontmost position and in which a soft recline characteristics is selected. FIG. 8 is a cross-sectional view along line A-A in FIG. 5. FIG. 9 is a cross-sectional view along line A-A in FIG. 5.

When the chair back is reclined further, the back bracket 43 tilts about the tilt axis 70. The movement of the back bracket 43 causes the rocker to pivot about rocker pivot 45. The yoke 64 is moved upward. While not shown in FIGS. 8 and 9, in use of the tilt mechanism, a closure member is provided at an upper end of the spring 61, causing the spring 61 to compress when the yoke 64 moves upward.

As can be seen from a comparison of FIG. 8 with FIG. 6, the reclining movement does not significantly affect the position at which the rocker bush 68 abuts on the interface section 49 of the rocker member 42. The torque exerted onto the chair back by the tilt mechanism, and thus the force which the chair back exerts onto the occupant at a given height of the chair back, is determined by the length of the lever arm between rocker bush 68 and rocker pivot 45, and by the length of another lever arm between the coupling section 47 and the tilt axis 70. Both lengths may be increased when making an adjustment of the tilt mechanism geometry from soft to hard recline characteristics, thereby increasing the force applied onto the occupant.

FIG. 10 shows the tilt mechanism 40 in a state which correspond to the state in which the chair back is in its frontmost position and in which a hard recline characteristics is selected. FIG. 10 is a cross-sectional view along line A-A in FIG. 5.

As can be seen upon comparison with FIG. 6, adjusting the tilt mechanism 40 from soft to hard recline characteristics causes the rocker with the rocker member 42 and the rocker pivot 45 to be displaced in a backward direction. During the adjustment, the rocker bush 68 slides along the interface section 49 of the rocker member 42. The coupling section 47 moves along the ledge 54 of the back bracket 43.

During the translational movement of the rocker, including the rocker pivot 45, the yoke 64 is essentially not shifted along the axis of the spring 61 as long as the chair back is maintained at the same recline angle, such as the frontmost position corresponding to zero recline angle. The compression of the spring 61 is then not modified during the transition from soft to harder recline characteristics. This similarly applied when going from hard to softer recline characteristics. If the torque exerted onto the chair back by the user, rather than the recline angle, is maintained constant during the adjustment, the change in leverage arm lengths will cause the spring 61 to compress or uncompress. The chair back is moved to a new recline angle, in which the torque exerted onto the chair back by the tilt mechanism 41 is equal in magnitude to the torque exerted onto the chair back by the user.

The rocker bush 68 which exerts the force from the spring 61 onto the rocker member 42 is now arranged at an end of the interface section 49 which is located away from the rocker pivot 45. The coupling section 47 is disposed in a backward position in which it is further away from the plane in which the tilt axis 70 is located than in the state in which soft recline characteristics is selected. The yoke 64 may still be at its lowermost position, in which the spring 61 has its minimum compression along the spring axis. When making the transition from soft to harder recline characteristics, the geometry of the tilt mechanism 40 is modified such that the length of the lever arm between rocker bush 68 and rocker pivot 45 is increased, and that the length of another lever arm between the coupling section 47 and the tilt axis 70 is increased. Both effects increase the force which the chair back applies onto the occupant in a recline movement of the chair back.

FIG. 11 shows the tilt mechanism 40 in a state which corresponds to the state in which the chair back is reclined and in which a hard recline characteristics is selected. FIG. 11 is a cross-sectional view along line A-A in FIG. 5.

During a reclining movement, the back bracket 43 tilts about the tilt axis 70. The movement of the back bracket 43 causes the rocker to pivot about rocker pivot 45. The yoke 64 is moved upward. While not shown in FIG. 11, in use of the tilt mechanism, a closure member is provided at an upper end of the spring 61, causing the spring 61 to compress when the yoke 64 moves upward. This result in an increasing force applied by the chair back onto the occupant as the chair back is reclined further.

An adjustment from soft to hard recline characteristics may be made at any recline angle. For illustration, the rocker with the rocker pivot 45 and rocker member 42 may be shifted in a translational manner relative to the base when the chair back is reclined. In this case, a transition is made from the configuration illustrated in FIGS. 8 and 9 to the configuration illustrated in FIG. 11. If the recline angle is maintained constant by the user, the spring is not compressed or uncompressed while the rocker is displaced in a translational manner. The resultant change in geometry of the tilt mechanism causes the lengths of lever arms to be modified. If the recline angle is not kept constant, the spring may compress or uncompress as a result of the adjustment, until a new equilibrium position is reached in which the torque exerted onto the chair back by the tilt mechanism is equal in magnitude to the torque exerted onto the chair back by the user.

The construction of the tilt mechanism 40 allows an adjustment from soft to hard recline characteristics to be made without applying significant forces, even when the chair back is already reclined. In tilt mechanisms according to embodiments, the path along which the rocker pivot and/or energy storage mechanism is displaced may extend essentially in the forward-backward direction 31 of the tilt mechanism. Forward and backward end portions of the rocker may be coupled to the energy storage mechanism and back bracket, respectively. For such a configuration, a significant component of the total force exerted onto the rocker pivot 45 by the back bracket 43 and the energy storage mechanism is oriented transverse to the direction along which the rocker pivot 45 is moved, when the chair back is reclined. The actuating mechanism only must overcome the component of the total force directed along the direction in which the rocker pivot 45 can be displaced by the actuation mechanism. This latter force component may be much smaller than the total force acting upon the rocker.

Figure 12:
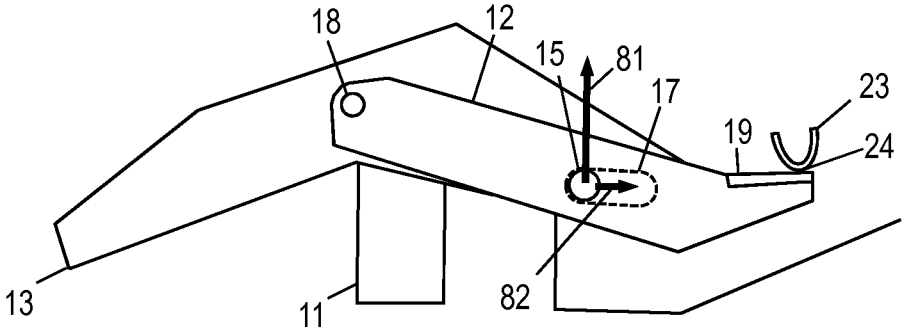
FIG. 12 is a schematic side view of a tilt mechanism illustrating forces acting upon a rocker pivot.

FIG. 12 illustrates forces acting onto a rocker 12 of a tilt mechanism according to an embodiment. While a schematic representation is shown in FIG. 12, this similarly applies to the tilt mechanism 40 of FIGS. 4-11.

When the chair back is reclined, a total force may act onto the rocker 12 which is much greater than in the state in which the chair back is not reclined. The total force has a component 81 directed transverse to the linear path along which the rocker 12 can be displaced by the actuation mechanism. The total force has another component 82 directed parallel to the linear path along which the rocker 12 can be displaced by the actuation mechanism. The force component 82 may be much smaller than the force component 81. The force component 81 is absorbed by the guide slot 17 and/or bearings which support the rocker pivot 15. The actuating mechanism only must overcome the smaller force component 82 which is directed along the guide slot 17.

For comparison, when a tension adjustment is made by adjusting a compression of the spring only, it is required to counteract significant forces when making the adjustment. The actuating mechanism must be engineered to withstand such forces when tension adjust is made via spring bias, which may add significantly to weight and cost.

Reverting to the tilt mechanisms of the embodiments of FIGS. 2-12, as the actuating mechanism must overcome forces which may be much smaller than the total force acting onto the rocker, the actuating mechanism may be designed such that a small "operation path," i.e., a small travel path of a manually operable actuating member may be sufficient to displace the rocker between its two extreme positions. For illustration, the actuating mechanism may be designed such that less than five full rotations, in particular less than one full rotation, of a manually operable actuating member displaces the rocker between its two extreme positions. A quick adjust mechanism is thereby implemented.

Figure 13:
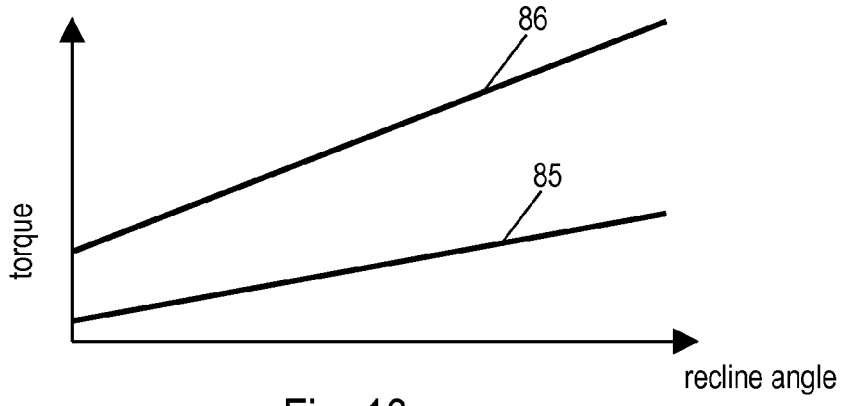
FIG. 13 is a diagram illustrating torque curves as a function of recline angle.

FIG. 13 is a diagram illustrating recline characteristics when the tilt mechanism is set to soft recline characteristics and hard recline characteristics, respectively. FIG. 13 shows the torque exerted onto the back bracket by the tilt mechanism as a function of recline angle. The force exerted onto the occupant by a given point of the chair back, such as an apex of the chair back, may be proportional to the torque.

For soft recline characteristics, the curve 85 shows the torque as a function of recline angle. For hard characteristics, the curve 86 shows the torque as a function of recline angle. For the tilt mechanism of embodiments, the slope of curve 85 may be different from the slope of curve 86. Using the tilt mechanism, the rate at which the torque exerted onto the chair back varies as a function of recline angle may be varied, using the actuating mechanism to change the geometry of the tilt mechanism.

For illustration, the tilt mechanism 10, 40 may include a setting mechanism which allows the orientation of the deformation axis of a spring or of another resiliently deformable member to be adjusted. Thereby, an angle between the deformation axis and the forward-backward direction of the tilt mechanism may be set, providing further enhanced control over the recline characteristics.

Figure 14:
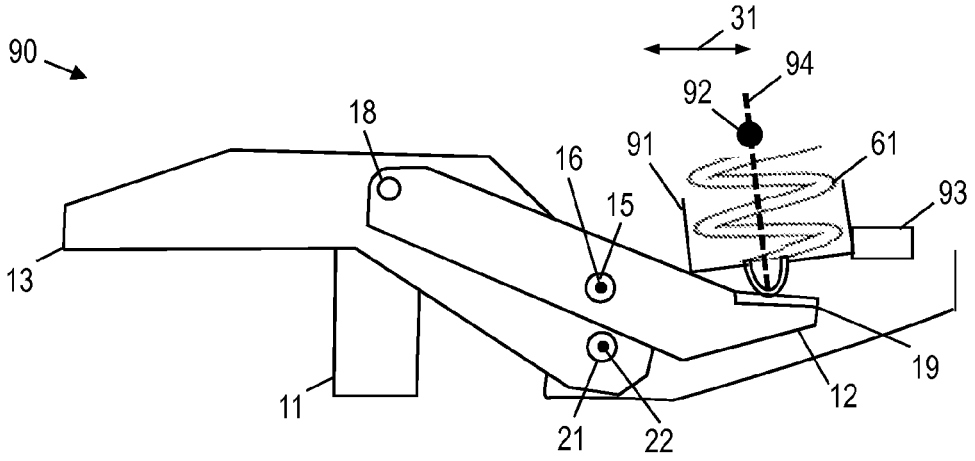
FIGS. 14 and 15 are side views of a tilt mechanism having a tension adjust mechanism, in which the torque curves for soft and hard recline characteristics are adjustable using a setting mechanism.
Figure 15:
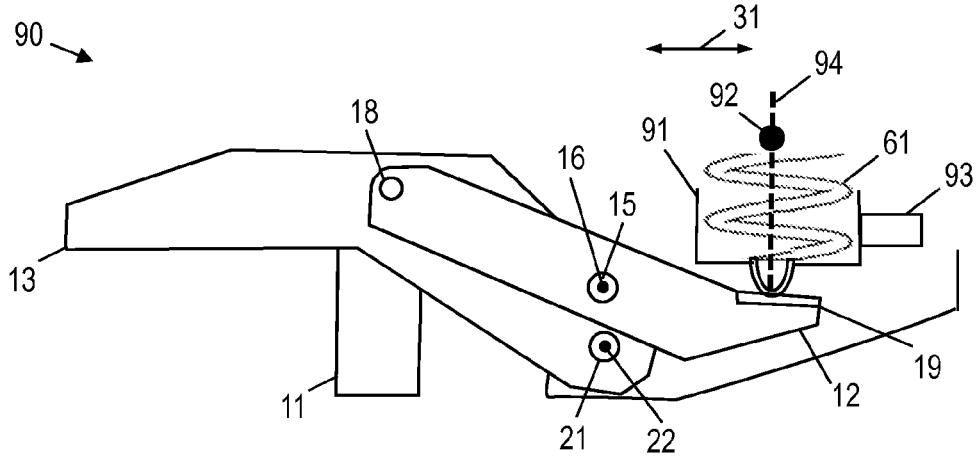

FIGS. 14 and 15 illustrate a tilt mechanism of an embodiment. The tilt mechanism includes a setting mechanism for setting an orientation of a deformation axis of the spring 61. The spring 61 is supported by a guide which includes an enclosure 91. The guide defines an axis 94 along which the spring 61 may compress or decompress. The guide is supported on the base 11 of the tilt mechanism such that the orientation of the axis 94 may be adjusted at least by a few degrees. A setting mechanism which sets the orientation of the axis 94 may include a hinge 92 to adjust the direction of the axis 94, and a fixation 93 to affix the guide in a position in which the axis 94 has a desired orientation.

FIGS. 14 and 15 show the tilt mechanism when the axis 94 defined by the guide is set to different orientations. The orientation of the axis 94 along which the spring 61 compresses is closer to 90° from the forward-backward direction of the tilt mechanism in the state shown in FIG. 15, compared to FIG. 14.

When the orientation of the axis along which the spring 61 is compressed is varied, the rate of change of the torque as a function of recline angle may be adjusted.

The setting mechanism may be provided such that it may be accessible for setting the orientation of the axis 94 upon assembly of a chair, but not in subsequent use. The orientation of the axis 94 may be set in dependence on the type of chair in which the tilt mechanism is to be installed and/or country where the chair is to be used. This allows the tilt mechanism to be configured so as to accommodate different customer's needs. For illustration, it may be desirable to vary the "soft" recline characteristics depending on in which country the chair is to be used. In particular, the rate of change of torque as a function of recline angle for the softest and/or hardest recline characteristics may be adjusted using the setting mechanism. This allows one tilt mechanism to be configured for different markets, obviating the need to build dedicated tilt mechanisms for different markets.

Figure 16:
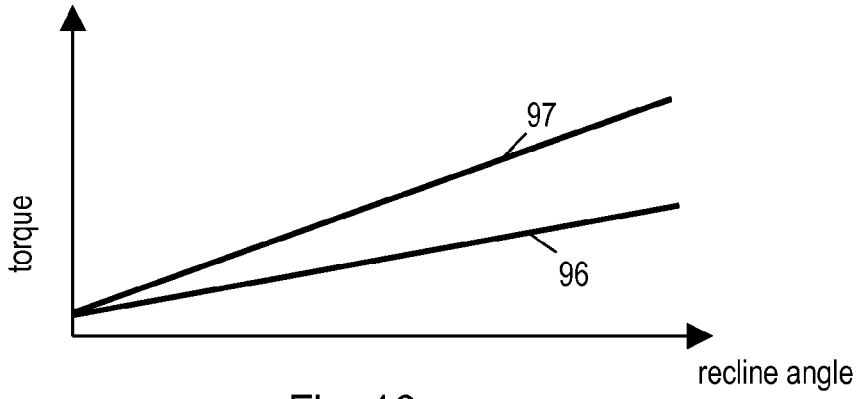
FIG. 16 is a diagram illustrating torque as a function of recline angle for different settings illustrated in FIGS. 14 and 15.

FIG. 16 is a diagram illustrating recline characteristics when an orientation of a spring axis is set in a tilt mechanism. FIG. 16 shows the soft recline characteristics for two different orientations of the spring axis relative to the forward-backward direction of the tilt mechanism. FIG. 16 shows the torque exerted onto the back bracket by the tilt mechanism as a function of recline angle. The force exerted onto the occupant by a given point of the chair back, such as an apex of the chair back, may be proportional to the torque.

The curves 96 and 97 respectively show the torque as a function of recline angle. The curve 96 is obtained for one orientation of the spring axis. The curve 97 is obtained for another orientation of the spring axis, in which the spring axis is arranged at an angle relative to the forward-backward direction of the tilt mechanism which is closer to 90° than for curve 96. By setting the spring axis orientation, the rate at which the torque exerted onto the chair back varies as a function of recline angle may be varied for soft and/or hard recline characteristics, using the setting mechanism to change the orientation of the spring axis.

The geometry of the tilt mechanism may be adjusted in a variety of ways in order to adjust the recline characteristics.

For illustration, the pivot axis of the rocker may be provided at a fixed location relative to the base. The location at which the energy storage mechanism exerts a force onto the rocker may be varied to adjust the recline characteristics. For illustration, the energy storage mechanism may be arranged such that it can be displaced relative to the base in a translational manner. The energy storage mechanism may be arranged such that it can be displaced relative to the base without changing the compression of a resiliently deformable member upon displacement.

Figure 17:
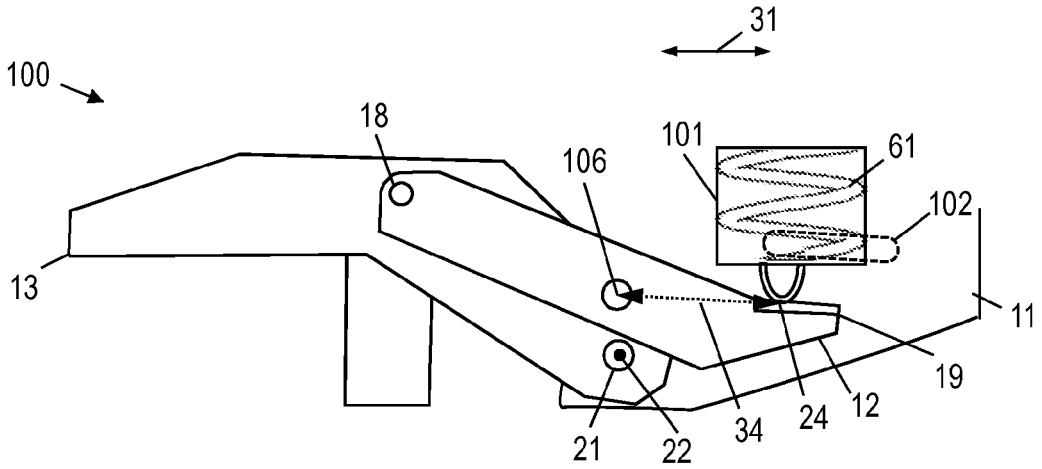
FIG. 17 is a side view of a tilt mechanism having a tension adjust mechanism, in a configuration in which the tilt mechanism provides soft recline characteristics.
Figure 18:
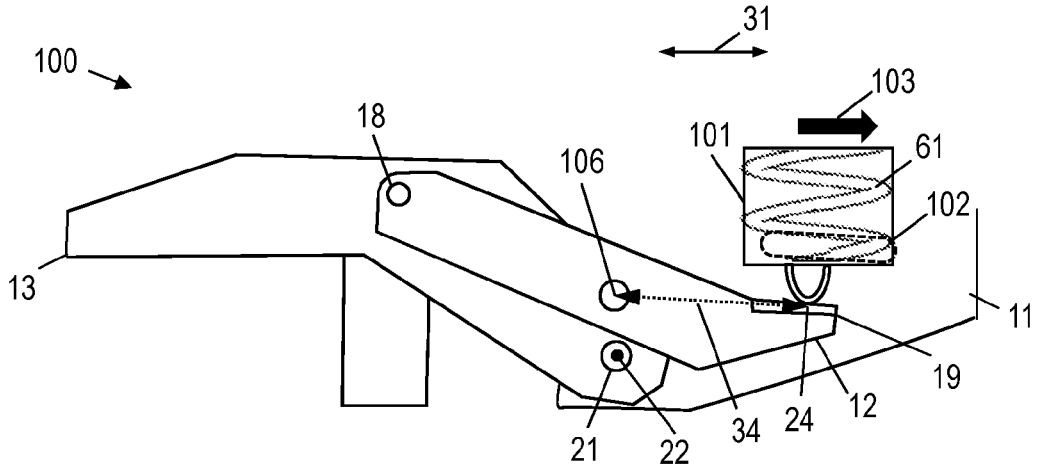
FIG. 18 is a side view of the tilt mechanism of FIG. 17 in a configuration in which the tilt mechanism provides hard recline characteristics.

FIGS. 17 and 18 are schematic side views of a tilt mechanism 100 according to an embodiment. Elements which correspond to elements explained with reference to any one of FIGS. 1-16 are designated with the same reference numerals.

The tilt mechanism 100 includes a base 11, a rocker 12, a back bracket 13, an energy storage mechanism and an actuating mechanism. The rocker 12 is mounted so as to be pivotable about a pivot axis 106. The location of the pivot axis 106 relative to the base 11 may be fixed.

The rocker 12 is coupled to the back bracket 13 via a coupling section 18. The coupling section 18 may include a roller abutting on a ledge of the back bracket.

The energy storage mechanism includes a resiliently deformable member 61, e.g. a spring. A deformation guide 61 guides a deformation movement of the deformable member 61. The deformation guide 101 may include a shaft extending through the deformable member 61 and/or a housing in which the deformable member 61 is housed. The deformation guide 101 is arranged to be displaceable relative to the base 11 and, thus, relative to the pivot axis 106 of the rocker. The guide 101 may be displaced along a guide slot 102 under the action of an actuating arrangement.

By displacing the energy storage mechanism, the geometry of the tilt mechanism is adjusted such that a length of a lever arm is changed. In the configuration shown in FIG. 17, the energy storage mechanism is positioned such that the position 24 at which it exerts a force onto the rocker 12 is closer to the rocker pivot 106 than in the configuration shown in FIG. 18. By displacing the energy storage mechanism, the length of the lever arm 34 may be adjusted. When the tilt mechanism is in the configuration in which the energy storage mechanism exerts the force at a position closer to the rocker pivot 106, the shorter lever arm leads to a softer recline characteristics than in the configuration in which the force is exerted onto the rocker pivot at a position 24 that is further away from the rocker pivot 106.

While tilt mechanisms according to embodiments have been described in detail with reference to the drawings, modifications thereof may be implemented in further embodiments. For illustration, additional mechanisms may be integrated into the tilt mechanism to implement additional functionalities. Examples for such mechanisms include mechanisms which couple the movement of a chair seat to the reclining movement of the chair back.

For further illustration, while tilt mechanisms have been described in which a rocker or an energy storage mechanism may be displaced to cause the length of at least one lever arm to change, both the rocker and the energy storage mechanism may be displaced relative to the base in tilt mechanisms of further embodiments.

For further illustration, while energy storage mechanisms including a spring have been explained in the context of some embodiments, any resiliently deformable member may be used.

For further illustration, while an actuating mechanism including a cam and pusher member has been explained, an actuating mechanism which defines the relative position between rocker pivot and energy storage mechanism may have any one of a variety of configurations. For illustration, a worm gear, wedges, or one or several cams may be used.

While exemplary embodiments have been described in the context of office-type chairs, the tilt mechanisms and chairs according to embodiments of the invention are not limited to this particular application. Rather, embodiments of the invention may be employed to realize a tension adjust feature in tilt mechanism for a wide variety of chairs.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, what is claimed is:

1. A tilt mechanism for a chair, said tilt mechanism being configured for adjustment of a tension applied by a chair back, said tilt mechanism comprising:

a base, a back bracket tiltably supported on said base and configured to be attached to said chair back, a rocker having a pivot axis provided at a fixed location relative to said rocker, said rocker being coupled to said back bracket so as to be moveable relative to said back bracket and being configured such that said rocker pivots about said pivot axis when said back bracket tilts relative to said base, an energy storage mechanism coupled to said rocker to exert a force onto a portion of said rocker which portion is spaced from said pivot axis by a distance, and an actuating mechanism coupled to at least one of said rocker or said energy storage mechanism and configured to alter said distance between said pivot axis and said portion of said rocker at which said force is exerted onto said rocker by a translational displacement of said pivot axis of said rocker or of said energy storage mechanism relative to said base.

2. The tilt mechanism of claim 1, wherein said actuating mechanism is configured to effect a relative displacement between said rocker and said energy storage mechanism.

3. The tilt mechanism of claim 2, wherein said actuating mechanism is configured to effect a linear translational displacement of said pivot axis of said rocker relative to said base.

4. The tilt mechanism of claim 3, wherein said energy storage mechanism includes a resiliently deformable member having a deformation axis, and said actuating mechanism is configured to alter a distance of said deformation axis from said pivot axis.

5. The tilt mechanism of claim 3, comprising a guide, in particular a linear guide, to guide said translational displacement.

6. The tilt mechanism of claim 5, wherein said tilt mechanism defines a forward-backward direction, and said guide extends in said forward-backward direction.

7. The tilt mechanism of claim 1, wherein said back bracket is supported on said base so as to be tiltable about a tilt axis, said tilt axis being parallel to and spaced from said pivot axis.

8. The tilt mechanism of claim 7, wherein said rocker exerts a further force onto said back bracket, and said actuating mechanism is configured to alter a length of a lever arm of said further force relative to said tilt axis.

9. The tilt mechanism of claim 7, wherein said rocker has a coupling section engaged with said back bracket, and said actuating mechanism is configured to, upon actuation of said actuating mechanism, displace said coupling section relative to said base.

10. The tilt mechanism of claim 1, wherein said energy storage mechanism includes a resiliently deformable member and a deformation guide guiding a deformation movement of said resiliently deformable member, said deformation guide being attached to said base.

11. The tilt mechanism of claim 10, wherein said base extends in a forward-backward direction of said tilt mechanism from a first end to a second end, and said deformation guide is attached to said base so as to be spaced from said first end and said second end of said base.

12. The tilt mechanism of claim 10, comprising a setting mechanism, wherein said deformation guide has a deformation guide axis along which said resiliently deformable member deforms, said setting mechanism being configured to adjust an orientation of said deformation guide axis relative to said base.

13. The tilt mechanism of claim 10, wherein said deformation guide supports opposite axial ends of said resiliently deformable member.

14. The tilt mechanism of claim 1, wherein said rocker includes a first rocker member and a second rock member, said first and second rocker members being spaced from each other in a direction parallel to said pivot axis.

15. The tilt mechanism of claim 1, comprising a seat support moveably supported on said base and configured to be attached to a chair seat, and a linkage coupling said seat support to at least one of said rocker or said back bracket.

16. A tilt mechanism for a chair, said tilt mechanism being configured for adjustment of a tension applied by a chair back, said tilt mechanism comprising:

a base:

a back bracket tiltably supported on said base and configured to be attached to said chair back:

a rocker having a pivot axis provided at a fixed location relative to said rocker, said rocker being coupled to said back bracket so as to be moveable relative to said back bracket and being configured such that said rocker pivots about said pivot axis when said back bracket tilts relative to said base;

an energy storage mechanism coupled to said rocker to exert a force onto a portion of said rocker which portion is spaced from said pivot axis by a distance; and an actuating mechanism coupled to at least one of said rocker or said energy storage mechanism and configured to effect a relative displacement between said rocker and said energy storage mechanism to alter said distance between said pivot axis and said portion of said rocker at which said force is exerted onto said rocker;

said rocker having an interface section slideably engaged with said energy storage mechanism and configured to remain engaged with said energy storage mechanism when said actuating mechanism effects said relative displacement.

17. A tilt mechanism for a chair, said tilt mechanism being configured for adjustment of a tension applied by a chair back, said tilt mechanism comprising:

a base;

a back bracket configured to be attached to said chair back;

a rocker having a pivot axis provided at a fixed location relative to said rocker, said rocker being coupled to said back bracket so as to be moveable relative to said back bracket and being configured such that said rocker pivots about said pivot axis when said back bracket tilts relative to said base, said rocker having a coupling section engaged with said back bracket;

an energy storage mechanism coupled to said rocker to exert a force onto a portion of said rocker which portion is spaced from said pivot axis by a distance; and an actuating mechanism coupled to at least one of said rocker or said energy storage mechanism and configured to, upon actuation of said actuating mechanism, displace said coupling section relative to said base to alter said distance between said pivot axis and said portion of said rocker at which said force is exerted onto said rocker;

said back bracket being supported on said base so as to be tiltable about a tilt axis, said tilt axis being parallel to and spaced from said pivot axis;

said actuating mechanism being configured to displace said coupling section away from a plane in which said tilt axis is located and to simultaneously increase said distance between said pivot axis and said portion of said rocker, when said actuating mechanism is actuated in a first direction, and to displace said coupling section towards said plane in which said tilt axis is located and to simultaneously decrease said distance between said pivot axis and said portion of said rocker, when said actuating mechanism is actuated in a second direction opposite to said first direction.

18. A tilt mechanism for a chair, said tilt mechanism being configured for adjustment of a tension applied by a chair back, said tilt mechanism comprising:

a base;

a back bracket configured to be attached to said chair back;

a rocker having a pivot axis provided at a fixed location relative to said rocker, said rocker being coupled to said back bracket so as to be moveable relative to said back bracket and being configured such that said rocker pivots about said pivot axis when said back bracket tilts relative to said base;

an energy storage mechanism coupled to said rocker to exert a force onto a portion of said rocker which portion is spaced from said pivot axis by a distance; and an actuating mechanism coupled to at least one of said rocker or said energy storage mechanism and configured to alter said distance between said pivot axis and said portion of said rocker at which said force is exerted onto said rocker;

said back bracket being supported on said base so as to be tiltable about a tilt axis, said tilt axis being parallel to and spaced from said pivot axis;

said rocker having a coupling section engaged with said back bracket; and said actuating mechanism being configured to, upon actuation of said actuating mechanism, alter an angle between a line connecting said coupling section and said pivot axis and another line connecting said coupling section and said tilt axis.

19. The tilt mechanism of claim 18, wherein said actuating mechanism is configured to decrease said angle and to simultaneously increase said distance between said pivot axis and portion of said rocker, when said actuating mechanism is actuated in a first direction, and to increase said angle and to simultaneously decrease said distance between said pivot axis and said portion of said rocker, when said actuating mechanism is actuated in a second direction opposite to said first direction.

20. A tilt mechanism for a chair, said tilt mechanism being configured for adjustment of a tension applied by a chair back, said tilt mechanism comprising:

a base:

a back bracket tiltably supported on said base and configured to be attached to said chair back;

a rocker having a pivot axis provided at a fixed location relative to said rocker, said rocker being coupled to said back bracket so as to be moveable relative to said back bracket and being configured such that said rocker pivots about said pivot axis when said back bracket tilts relative to said base;

an energy storage mechanism coupled to said rocker to exert a force onto a portion of said rocker which portion is spaced from said pivot axis by a distance; and an actuating mechanism coupled to at least one of said rocker or said energy storage mechanism and configured to alter said distance between said pivot axis and said portion of said rocker at which said force is exerted onto said rocker, said actuating mechanism having a manually operable actuating element and being configured such that less than five full 360° turns of said actuating element are required to alter said distance between said pivot axis and said portion of said rocker at which said force is exerted onto said rocker from a maximum distance to a minimum distance.

21. A chair, comprising a chair base assembly, a chair seat, a chair back, and a tilt mechanism according to claim 1, said base of said tilt mechanism being attached to said chair base assembly and said chair back being affixed to said back bracket.

* * * * *